US008020483B2

(12) United States Patent
Benyami et al.

(10) Patent No.: US 8,020,483 B2
(45) Date of Patent: Sep. 20, 2011

(54) ARMOR MODULE

(75) Inventors: Moshe Benyami, Haifa (IL); Samuel Friling, Kfar Vradim (IL); Erez Hanina, Haifa (IL); Gili Hazan, Nofit (IL)

(73) Assignee: Rafael, Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 12/232,613

(22) Filed: Sep. 19, 2008

(65) Prior Publication Data

US 2009/0107326 A1 Apr. 30, 2009

(30) Foreign Application Priority Data

Sep. 20, 2007 (IL) ..... 186152

(51) Int. Cl.
*F41H 11/00* (2006.01)

(52) U.S. Cl. ..... 89/36.17; 89/36.08; 89/36.01; 89/36.04

(58) Field of Classification Search ..... 89/36.17, 89/36.04, 36.07, 36.09; 109/36, 37
See application file for complete search history.

(56) References Cited

U.S. PATENT DOCUMENTS 4,741,244 A 5/1988 Ratner et al.
5,012,721 A * 5/1991 Medin et al. ..... 89/36.17
5,070,764 A * 12/1991 Shevach et al. ..... 89/36.17
5,803,212 A * 9/1998 Reinehr et al. ..... 188/372
6,758,125 B1 * 7/2004 Zank ..... 89/36.17
7,080,587 B2 7/2006 Benyami et al.
2005/0132873 A1 * 6/2005 Diaz Supisiche et al. ... 89/36.01
2007/0039837 A1 * 2/2007 Hanina et al. ..... 206/204

FOREIGN PATENT DOCUMENTS

DE 37 08 927 C1 10/1998
EP 0 860 678 A1 8/1998

OTHER PUBLICATIONS

Extended European Search Report issued on Mar. 18, 2011, in corresponding European Application No. 08164688.7.

* cited by examiner

*Primary Examiner* — Michael Carone
*Assistant Examiner* — Daniel J Troy
(74) *Attorney, Agent, or Firm* — The Nath Law Group; Susanne M. Hopkins; William L. Klima

(57) ABSTRACT

A reactive armor module for protecting a target from an incoming projectile, and comprising at least one armor cassette formed of a front base plate and a rear base plate sandwiching between them at least one layer of energetic material, the front base plate and the rear base plate being adapted, upon impact of the projectile with the energetic material, to be propelled in opposite directions; the armor module further comprising at least one non-energetic auxiliary plate spaced from the armor cassette and positioned essentially along the expected trajectory of either the front or the rear base plate, such that when propelled, the velocity of a base plate facing the auxiliary plate is reduced upon collision with the auxiliary plate.

19 Claims, 6 Drawing Sheets

ARMOR MODULE

FIELD OF THE INVENTION

This invention relates to armor modules fitted for attaching to the outside of a body liable to be exposed to attack by projectiles, e.g. shaped-charged warheads, kinetic energy projectiles and the like. Examples of bodies protectable by armor models in accordance with the present invention are, for example, land vehicles such as battle tanks, armored personnel carriers, armored fighting vehicles, armored, self-propelled guns; marine and navy crafts, static structures and enclosures such as buildings, above-ground portions of bunkers, containers of various nature, for the storage of fuel, chemicals, ammunitions, etc. all of which are collectively referred to herein after as a 'target'.

BACKGROUND OF THE INVENTION

Reactive armor cassette modules are known in the art for forming an armor adapted to protect a body from an incoming projectile, and are especially effective against hollow charges. Hollow charges usually comprise an explosive charge set behind a liner which is adapted to transform the liner into a powerful and directional jet adapted to penetrate the body to be protected.

A standard reactive armor cassette module usually comprises two plates having sandwiched between them an explosive material, usually referred to as Explosive Reactive Armor (ERA). The explosive material is adapted to explode upon impact of the directional jet therewith, and thereby propel the two plates in essentially opposite directions. The cassette modules are often positioned on the body to be protected at an angle to the expected impact direction of the projectile, whereby upon propulsion of the plates and their subsequent movement, the jet is dispersed upon the plate, whereby its penetration capability is greatly reduced.

In order to increase the efficiency of a reactive armor, a plurality of cassettes in a variety of configurations may be used. The armor cassette modules may be spaced apart to cover a greater area of the body to be protected, be angled to each other and even be compactly packed within an armor module.

For example, U.S. Pat. No. 7,080,587 discloses an armor module comprising a rigid casing having a front face, a top face and a bottom face, and a plurality of multi-layer planner cassettes fixedly mounted within the casing. Each cassette has a top base plate and a bottom base plate, sandwiching between them at least a one other layer. The top base plate of an uppermost cassette constitutes the top face of the casing, and a bottom base plate of a lowermost cassette constitutes the bottom face of the casing.

U.S. Pat. No. 4,741,244 discloses an armor for Protection of land vehicles such as tanks, armored cars or the like against shaped charge projectiles. Protection is achieved by a cover member having suspended therefrom on the side that faces the substrate at least one explosive insert comprising an explosive layer sandwiched between two metal layers, such that when the element is mounted on the substrate the explosive insert remains distanced therefrom.

SUMMARY OF THE INVENTION

According to one aspect of the present invention there is provided a reactive armor module adapted to protect a target from an incoming projectile, and comprising an armor cassette formed of a first base plate and a second base plate sandwiching between them at least one layer of energetic material, said first base plate and said second base plate being adapted, upon impact of said projectile with said explosive, to be propelled in opposite directions, said armor module further comprising at least one non-energetic auxiliary plate spaced from said armor cassette and positioned essentially along the expected trajectory of either said first or said second base plate, such that when propelled, the velocity of either said first and/or said second base plate is adapted to be reduced upon collision with said auxiliary plate.

The layer of energetic material sandwiched between said first and said second plate may be of either an explosive or non-explosive material.

The reactive armor module may comprise a plurality of armor cassettes, each having a construction similar to the above described armor cassette, said cassettes may be spaced apart from each other. For example, a reactive armor module may comprise two cassettes.

Said reactive armor module may comprise a number of auxiliary plates, positioned in the front or in the rear of the base plates, 'front' and 'rear' being defined with respect to the expected direction of said incoming projectile.

According to a specific design, said armor module comprises two auxiliary plates, one being spaced from said front base plate, and another being spaced from said rear base plate, i.e. said cassette being sandwiched between said auxiliary plates.

A longitudinal dimension 'L' of the armor cassette, a distance 'd' between the auxiliary plate and the respective base plate of about 5-20% 'L' was found to provide improved results. For example, if the longitudinal dimension of said base plate is 300 mm, said auxiliary plate may be spaced at a distance of 15 mm therefrom.

It would be readily appreciated that the term 'plate' used herein is not restricted and applies for a variety of thicknesses which may range from about 2 to about 10 mm.

According to a specific design variation, the auxiliary plate is positioned substantially parallel to the base plate, such that, when propelled by said explosive, said base plate is designed to collide with said auxiliary plate and have a maximal contact area.

The base plates and the auxiliary plate may be made of a variety of materials. The materials may be chosen such that the collision between either of said base plates and said auxiliary plate is either of plastic or elastic nature. For example, while the base plates may be made of steel, said at least one auxiliary plate may be made both of metallic materials such as soft steel, Aluminum or Titanium and non-metallic materials including Aramid (Kevlar®), HDPE (Dynema®), Zylon® and ceramic materials.

In case ceramic material, and/or any form of ballistic fibers are used for the production of said auxiliary plate, said auxiliary plate may further provide protection against light firearm threats such as automatic machine gun, rifles etc.

The explosive layer between said first base plate and second base plate may be a sheet of energetic (reactive) material as known per se, adapted to explode upon impact of said projectile therewith.

The armor may be directly mounted onto the target to be protected and may be positioned thereon in a slanted orientation with respect to the expected direction of said incoming projectile. A slanted orientation may provide for greater efficiency of the armor as known per se. a plurality of armor modules may be mounted onto the target body allowing better coverage and overlap so as to provide improved protection thereof.

By a particular design of the invention, the armor cassette is confined within a casing having at least two walls to form an armor module adapted to be mounted onto the target body to be protected. Said walls may be made of a variety of materials, e.g. steel, metal etc. The walls of the armor module may be so designed as to allow mounting of a plurality of similar armor modules onto said target in a tessellated form, e.g. a top wall of one module extending adjacent or flush against a bottom wall of an adjacent module.

According to a specific design variation, the armor module comprises a casing formed with two side walls and the cassette and the auxiliary plate extend between said side walls. The extremities of said auxiliary plate are attached to the side walls of said casing, thereby increasing structural strength of the armor module. More particularly, said extremities may be inserted into pre-formed punctures/slots/ apertures in said side walls and then soldered or otherwise attached thereto. In addition, said auxiliary plate and said casing may be made of the same material, which provides for a more simplified production. According to another specific design, said auxiliary plate may be constituted a part of said casing.

The armor module may comprise one or more armor cassettes and corresponding auxiliary plates disposed therein, and the cassettes may be inclined with respect to each other so as to provide protection against various expected directions of an incoming projectile.

In operation, when an incoming projectile, for example a hollow charge, impacts the armor module, the jet formed by the hollow charge may likely initiate explosion of the energetic material sandwiched between the first and second base plates. The explosion of the energetic material then propels the first and second base plates very rapidly in opposite directions, normal to the surface of the plates, the first base plate moving outwards of the target to be protected and the second base plate moving inwards. The energetic material thus allows quick reaction to the impact of the jet, and causing its disruption.

The first base plate and/or the second base plate may plastically collide with an associated stationary auxiliary plate. Such collision will result in mutual movement of the auxiliary plate with the base plate colliding with it, in essentially the same direction, however at a reduced mutual speed. Said reduced mutual speed may be determined based on the initial velocity of said base plate and the masses of both said base and auxiliary plate.

Alternatively, said collision may be of fully or partially elastic nature, whereby said auxiliary plate is adapted to gain movement upon collision of said base plate therewith, whereby said the velocity of said base plate is consequently reduced. The velocity of movement of said auxiliary plate, and the reduced velocity of said base plate may be determined by the initial velocity of said base plate and the mass ratio between said base plate and said auxiliary plate.

When directional jets are concerned, it is known that the leading end of the directional jet usually travels with a greater speed than that of the trailing end of the directional jet. For example, the velocities of the leading and trailing ends may be 5 Km/s and 1 Km/s respectively. Thus, when designing armor panels, although a very short time interval is desired for reaction to the impact of said leading end, it is not desired for the plates to move too quickly, thus being unable to absorb and scatter the trailing end of said directional jet.

Thus, it would be appreciated, that by controlling the number of auxiliary plates used in one reactive armor module, the material from which they are made and additional design parameters such as mass, distance, thickness etc. it is possible to manipulate said armor module to provide, upon impact of a directional jet therewith, an array of moving plates the velocity and orientation of which correspond to the various velocities of the directional jet from leading to trailing end.

According to one such example of an armor module, said armor module comprises two auxiliary plates. Thus, activation of the energetic material may result in four moving plates, each having a different velocity which provides for an encounter of the plates with various portions of various velocities of the directional jet. However, this is achieved, compared to an armor module having two reactive armor cassettes, with the use of only one armor cassette module, allowing a substantial reduction ob about 30% in the overall weight of the armor module.

In particular, another important advantage of the present invention is noticed when a reactive armor module is mounted on a body to be protected such that said at least one auxiliary plate is positioned between said armor cassette and a hull of said body to be protected. In this case, a predetermined distance is formed between said rear base plate and the hull of said body to be protected. According to the present invention, due to the reduction of the velocity of the moving base and/or auxiliary plate, the time required to displace along said predetermined distance is prolonged, effectively increasing the contact time between said moving plate and said directional jet, providing for better use of said distance.

In the event several armor cassettes are used in a single module, an explosion in one of the reactive cassettes, and subsequent propulsion of the base plates may cause one of the base plate to impact an adjacent cassette armor. This may cause a chain reaction or 'domino' effect in which each cassette armor is activated by a propelled base plate or at least displaced or deformed thereby. This effect is usually referred to in the art as 'sympathetic detonation'. In order to prevent the 'sympathetic detonation', a shock absorbing layer may be coupled to the armor cassettes, such that a propelled base plate encounters said layer prior to impact with said adjacent cassette armor, the shock absorbing layer being adapted to reduce the kinetic energy of said propelled base plate. The shock absorbing layer may in the form of a one or more layers of elastic material, which in turn may be reinforced.

The following advantages may arise from the above described invention:

- overall increase of about 20% in the effectiveness of the armor module compared to a standard design;
- considerable reduction of weight of about 30% compared to a standard design;
- an increase in the survivability of the target to be protected both due to efficiency of the armor module and due to reduced amount of overall energetic material;
- reduced assembly time due to a simpler design;
- cost efficient due to the reduction in the amount and variety of materials, both of the base plates and the energetic material;

The above described reactive armor module and armor module may typically be mounted on a passive armor of the target body to be protected. Thus, among other advantages of the present invention is the fact that the weight of such a passive armor may be increased due to the reduction in the overall weight of the reactive armor. Increasing the weight of said passive armor subsequently increases it's effectiveness, allowing it to better withstand explosions and impact of Improvised Explosive Devices (IED).

According to another aspect of the present invention there is provided an armor module adapted to protect a target from an incoming projectile, said armor module comprising at least one armor module cassette confined between two side walls of a casing, said module comprising an armor cassette formed of a first base plate and a second base plate with at least one layer sandwiched of energetic material therebetween, said first base plate and said second base plate being adapted, upon impact of said projectile with said explosive to be propelled thereby at a predetermined velocity and in opposite directions, said armor module further comprising at least one non-energetic auxiliary plate spaced from said armor cassette and positioned essentially along the expected trajectory of either said first or said second base plate, such that when propelled, the velocity of either said first and/or said second base plate is adapted to be reduced due to collision with said auxiliary plate.

The present invention calls also for a method for protection a target body against projectiles, the method comprising the following steps:

fitting the body on an outside thereof with at least one armor module for protection against said projectiles and shaped-charged warheads, said armor module comprises at least one armor module cassette confined between two side walls of a casing, said module comprising an armor cassette formed of a first base plate and a second base plate with at least one layer sandwiched of energetic material therebetween, said first base plate and said second base plate being adapted, upon impact of said projectile with said explosive to be propelled thereby at a predetermined velocity and in opposite directions, said armor module further comprising at least one non-energetic auxiliary plate spaced from said armor cassette and positioned essentially along the expected trajectory of either said first or said second base plate, such that when propelled, the velocity of either said first and/or said second base plate is adapted to be reduced due to collision with said auxiliary plate.

BRIEF DESCRIPTION OF THE DRAWINGS

In order to understand the invention and to see how it may be carried out in practice, several embodiments will now be described, by way of non-limiting examples only, with reference to the accompanying drawings, in which.

DETAILED DESCRIPTION OF EXEMPLARY EMBODIMENTS

Figure 1A:
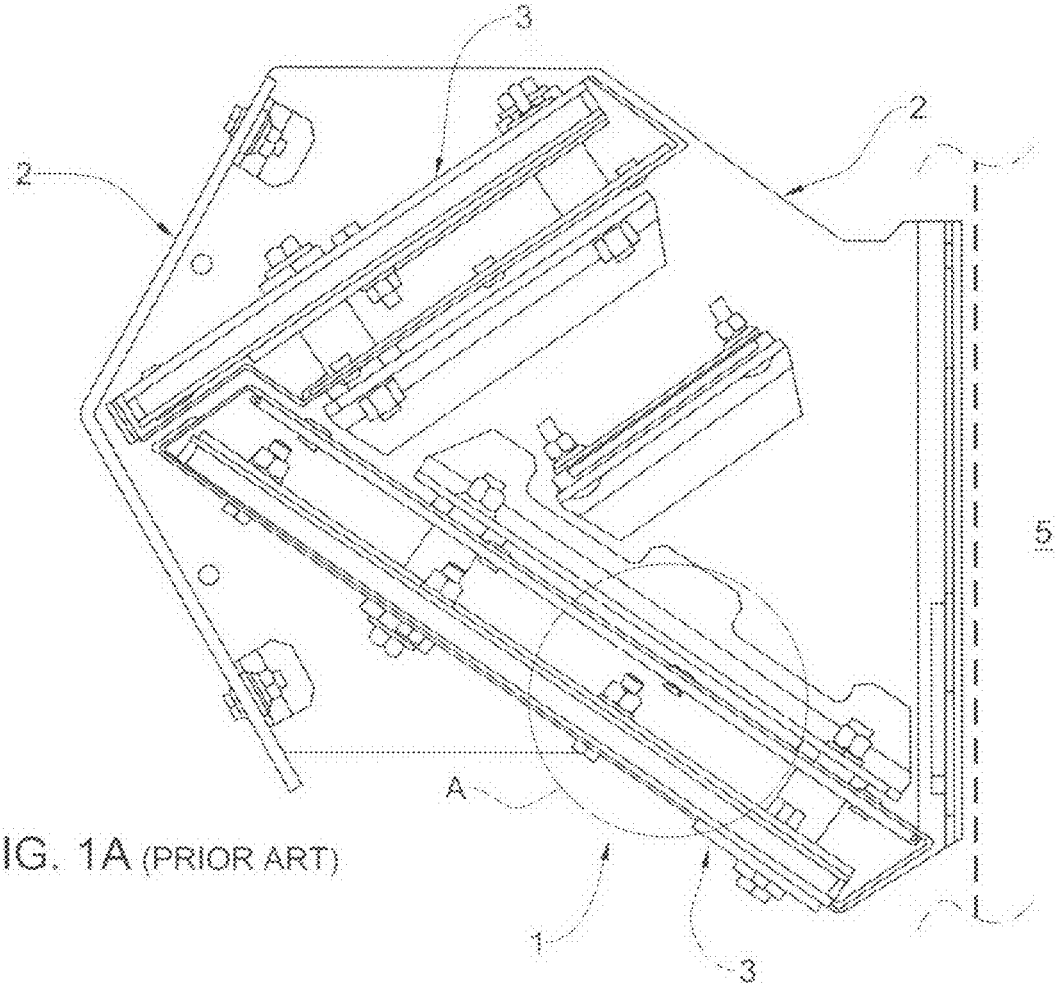
FIG. 1A (PRIOR ART)
FIG. 1A is a schematic cross section view of a prior art armor module.
Figure 1B:
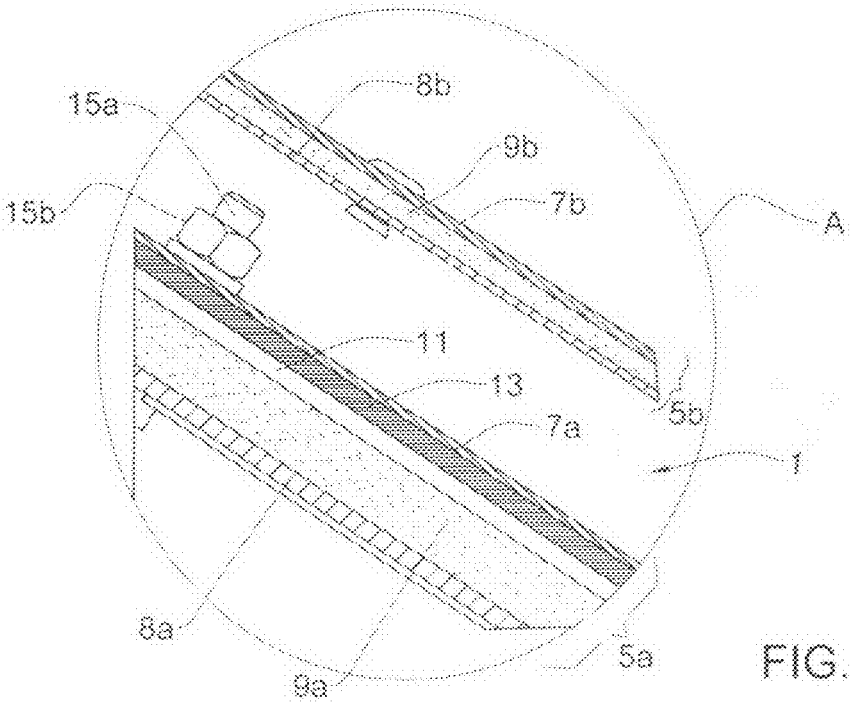
FIG. 1B (PRIOR ART)
FIG. 1B is an enlargement of detail 'A' of FIG. 1A.

FIGS. 1A and 1B show a standard armor module as known in the art, generally designated 1, and comprising a casing 2 and two armor elements 3. The armor module 1 is attached onto a target body to be protected 5, schematically illustrated here in phantom lines.

As best seen in FIG. 1B, each armor elements 3 comprises a first thick armor cassette 5*a* and a second thinner armor cassette 5*b*. The thick armor cassette 5*a* comprises an rear steel plate 7*a* and a front steel plate 8*a* sandwiching between them a layer of energetic material 9*a*. Between the two plates 7*a* and 8*a*, an additional steel plate 11 is positioned along with a rubber layer 13. The layers of the armor cassette 5*a* are held together using a bolt 15*a* and nut 15*b* assembly.

The second, thinner armor cassette 5*b* also comprises two steel plates 7*b*, 8*b* with and energetic material 9*b* sandwiched therebetween. The second armor module 5*b* is thinner than the armor cassette 5*a* due to a thinner layer of energetic material 9 and absence of the additional steel plate 11 is positioned along with a rubber layer 13 provided in armor cassette 5*a*.

Figure 2A:
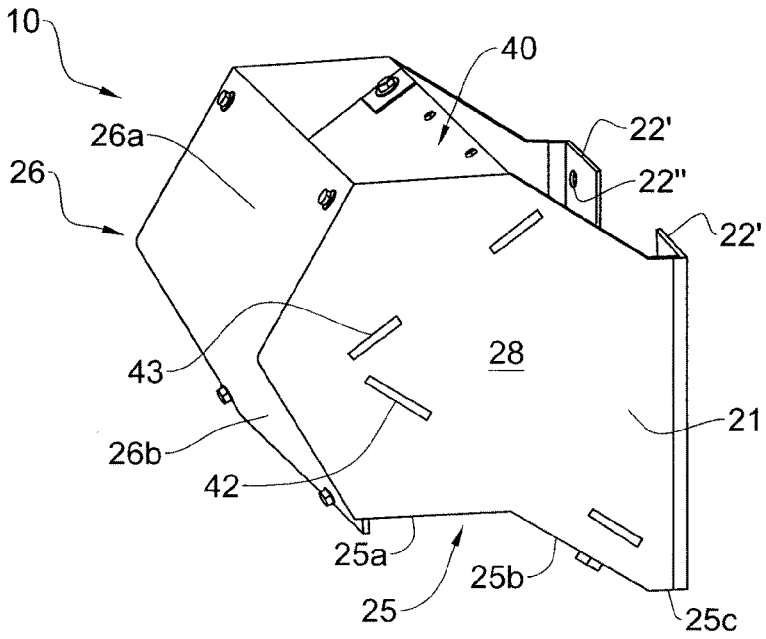
FIG. 2A is a schematic isometric view of an armor module according to the present invention.
Figure 2B:
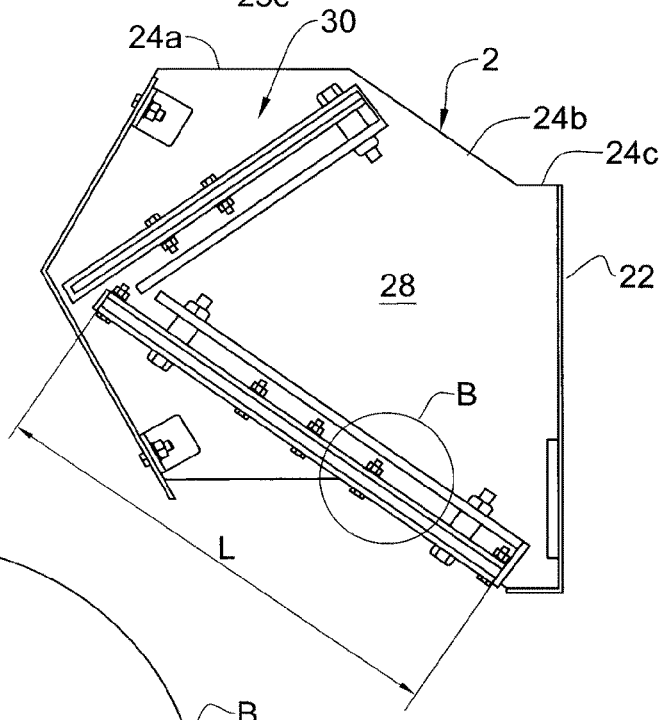
FIG. 2B is a schematic cross section view of the armor module shown in FIG. 2A.
Figure 2C:
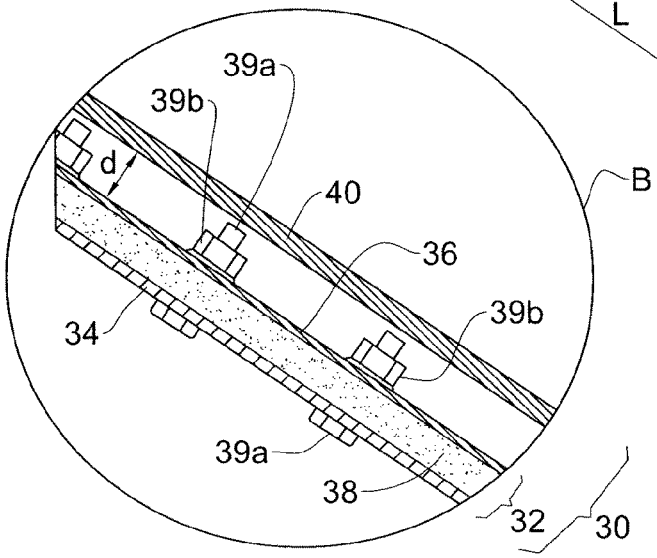
FIG. 2C is an enlargement of detail 'B' of FIG. 2B.

Turning to FIGS. 2A to 2C, an armor module according to the present invention, generally designated 10 is shown comprising a casing 21 containing two armor cassettes 30 (FIG. 2B). Each armor cassette 30 comprises an explosive armor cassette 32 comprising in turn a front steel plate 34 and a rear steel plate 36 sandwiching between them a layer of energetic material 38, and an auxiliary plate 40 extending behind the rear steel plate 36 and spaced from said explosive armor cassette 32 (i.e. from the rear plate 38) at a distance d (FIG. 2C). The terms 'front' and 'rear' used herein are defined with respect to the expected direction of said incoming projectile The casing 21 is formed of a rear wall 22, two side walls 28, a front wall 26, a bottom edge 24, and top and bottom edges 24 and 25 respectively. The rear wall is in the form of two flanges 22' adapted to be connected to a target body to be protected (not shown), for example by a bolt and but assembly (not shown) through apertures 22" (FIG. 2A). The bottom edge 25 is formed of three sections 25*a*, 25*b* and 25*c* angled to each other, and the top edge 24 is formed of three respective parallel sections 24*a*, 24*b* and 24*c*. The front wall 26 is formed of two sections 26*a* and 26*b* angled to each other. The design of the casing 20 allows a plurality of such modules 10 to be positioned one above the other in a tessellated manner such that, for example, the section 25*a* of a bottom edge 25 of one module 10 comes in contact with a section 24*a* of the top edge 24 of a downwardly adjacent module (not shown).

In accordance with a particular embodiment, the rear steel plate 36 has a longitudinal dimension 'L' (FIG. 2B) of about 300 mm and the auxiliary steel plate 40 is spaced at a distance 'd' of about 15 mm therefrom, which is 5% of the length 'L'. The auxiliary plate 40 is attached directly to the casing 20 by lateral extensions 42 integral therewith inserted into slots 43 formed in the side walls 28. In assembly the extensions 42 are inserted into the slots 43 and then welded in place thereby fixing the auxiliary plate 40 firmly to the casing 20. Such an attachment, i.e. directly to the casing 20, also provides structural strength to the whole module 10.

Figure 2D:
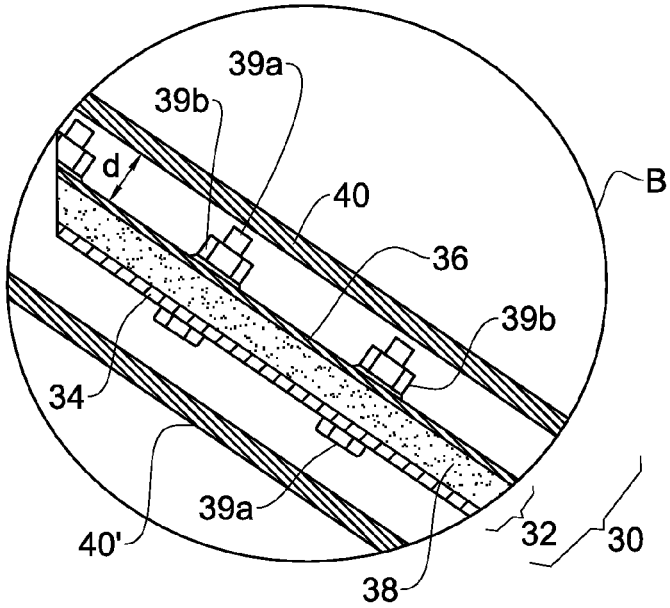
FIG. 2D is a schematic cross-sectional view of a portion of the armor module according to another exemplary embodiment of the present application.

With reference to FIG. 2D, it is appreciated that according to another example of the armor module, the latter can comprise an additional auxiliary plate 40' located on the other side of the armor cassette 30, i.e. in front of the cassette.

Figure 3A:
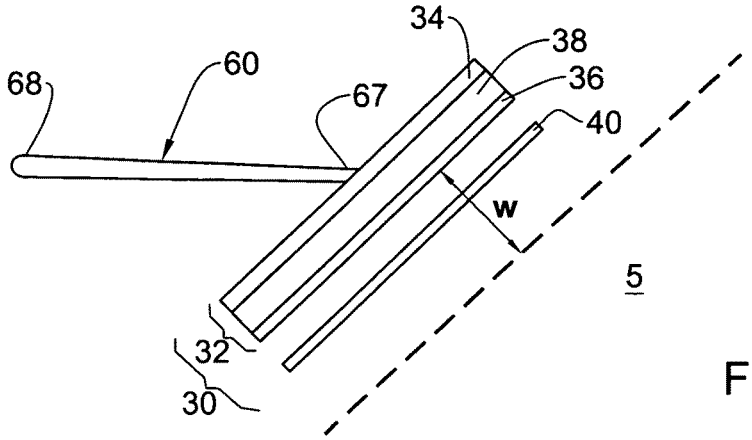
FIGS. 3A to 3C are schematic illustrations of an armor cassette according to one example of the present invention during impact of a directional jet thereon, in which the auxiliary plate is positioned behind the armor cassette.

Turning to FIG. 3A, an illustration of a high speed photograph of armor cassette 30 according to the present invention is shown an instance before a jet 60 of a hollow charge strikes the explosion armor cassette 32. The target body to be protected 5 on which the armor module 30 is mounted is shown in phantom line, being spaced apart at a distance 'w' from the armor cassette 32.

Figure 3B:
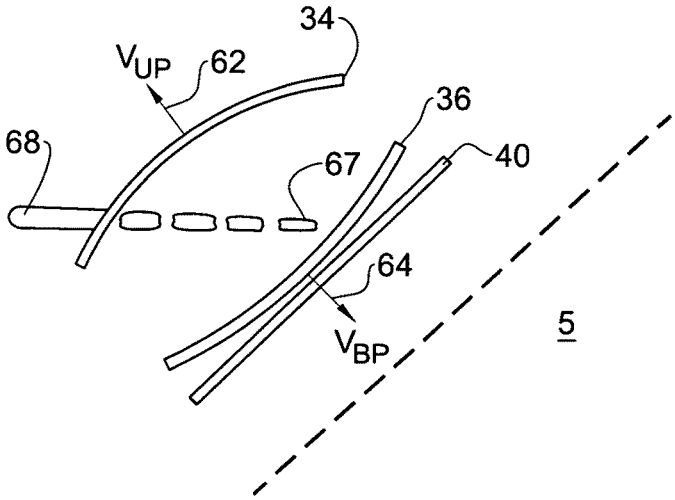
Figure 3C:
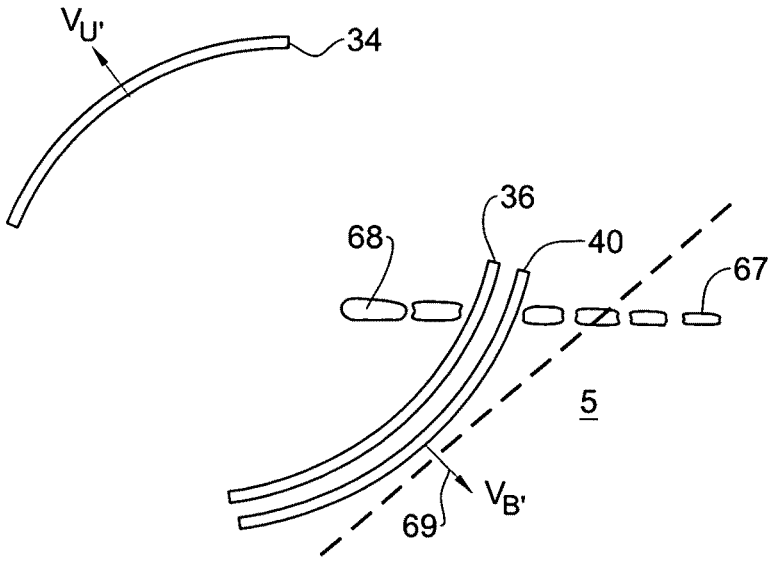

FIG. 3B illustrates the explosion armor cassette 30 an instance after explosion of the energetic material 38 upon hitting and exiting by the jet 60. The front plate 34 is propelled at an essentially upward direction of arrow 62 and the rear plate 36 is propelled at an essentially opposite and parallel, downward direction of arrow 64, both having initial velocities $V_{UP}$ and $V_{BP}$ respectively. Displacement and deformation of the plates 34 and 36 disperses and scatters the jet 60. In FIG. 3C the rear plate 36 is further deformed and propelled towards the auxiliary plate 40 which now deforms also and displaces together with the rear plate 36, whereby the power of the distal end (leading end) 67 of the jet is significantly reduced.

As opposed to a standard armor cassette previously described, after exciting the explosive material and propelling the rear plate 36 towards the auxiliary plate 40, the rear plate 36 together with the auxiliary plate 40 acquire a velocity $V_{B'}$ whereby $V_{B'}<V_{B'}$ and where $V_B<V_U'$ designated by arrow 69 in FIG. 3C, thus still coming in contact with the slower, trailing end 68 of the jet 60.

It would thus be readily appreciated that an array of auxiliary plates 40 may be employed within the armor module 10, whereby the velocity of the base plates 34, 36 is gradually reduced to correspond to the varying velocity of the jet 60, providing high efficiency of the armor module 10.

It would also be appreciated, that due to the presence of the auxiliary plate 40, and subsequent reduction in velocity of the base plate 34, the time required for the plate 34 to travel from its initial position to the body to be protected 5 lengthens. This lengthening in time is equivalent to an effective contact time with the jet 60. Thus, according to the present invention, the distance 'w' is better utilized compared to an armor module 1 according to the prior art.

Figure 3D:
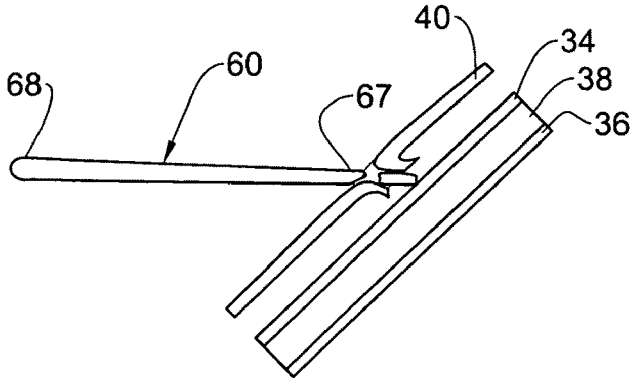
FIGS. 3D to 3F are schematic illustrations of an armor cassette according to another example of the present invention during impact of a directional jet thereon, in which the auxiliary plate is positioned in front of the armor cassette.
Figure 3E:
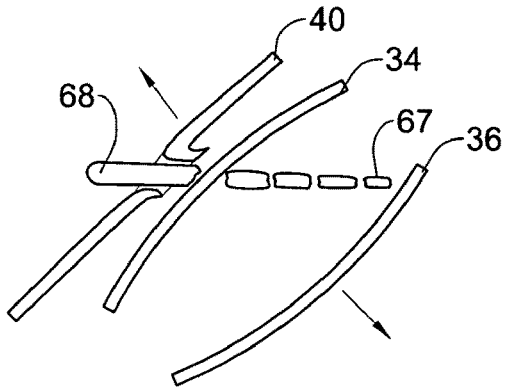
Figure 3F:
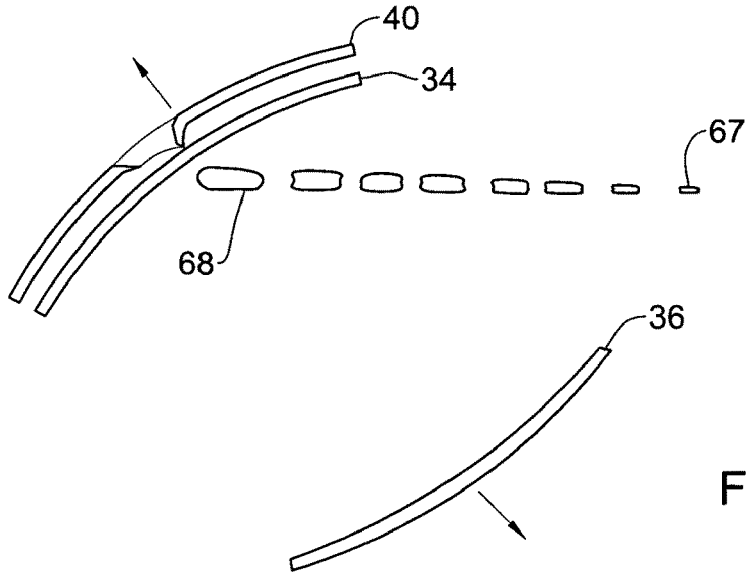

Turning to FIGS. 3D to 3F, another example of an armor module is shown in which the auxiliary plate 40 is positioned in front of the armor cassette. According to this example, the trailing end 68 of the jet 60 is eventually contacted by the upper base plate 34 and the auxiliary plate 40.

It would thus be appreciated that a variety of modules 10 according to the present invention may be construed, including ones having auxiliary plates 40 both in front and behind the armor cassette 30, and any combination thereof including more than two auxiliary plates 40.

Figure 4:
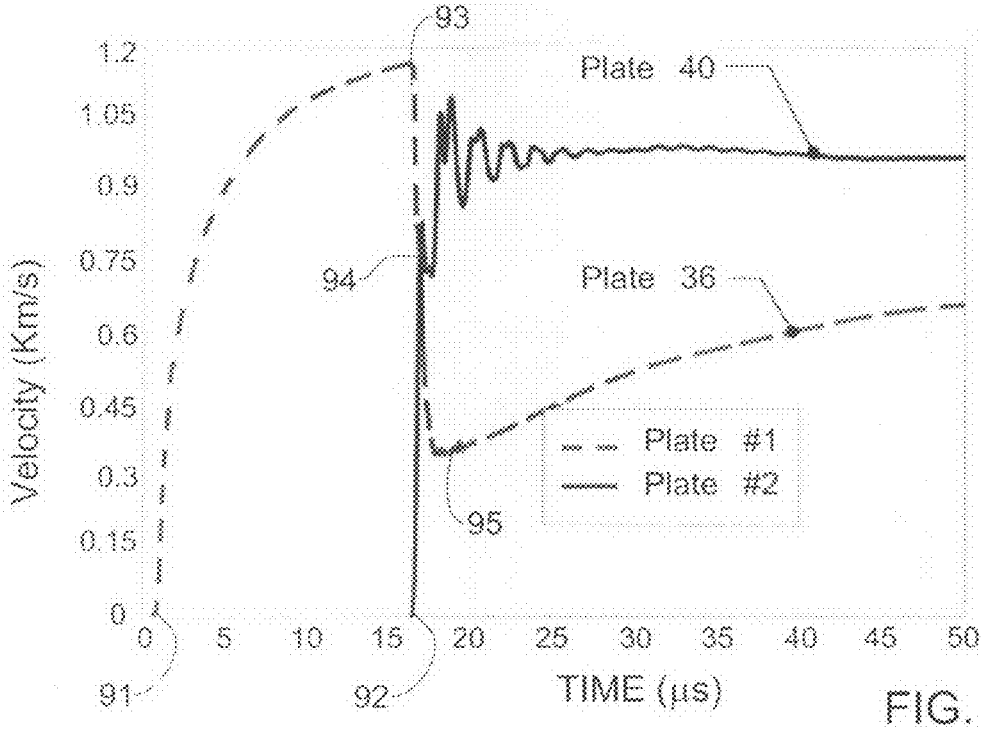
FIG. 4 is a scheme of Velocity vs. Time of base plates used in an armor cassette according to the present invention.

Turning to FIG. 4, the chart shows the velocities of both the rear plate 36 and the auxiliary plate 40 as a function of time. Practically immediate after the impact (at t=~1 μs), explosion of the energetic material 38 is initiated by the jet 60 causing initial movement of the rear plate 36 designated by point 91. As the shock wave of the explosion progresses and the rear plate 36 deforms and displaces (FIG. 3B) and acquires an initial velocity $V_B$ of about 1.2 Km/s designated by peak 93. Upon impact with the auxiliary plate 40 (at t=~17 μs), designated at point 92, the speed of the rear plate 36 drops to about 0.35 Km/s (designated at point 95) where part of the kinetic energy is transferred to the auxiliary plate 40 which deforms and displaces with the rear plate 36, whereby the auxiliary plate acquires a velocity $V_{B'}$ of about 0.85 Km/s designated by peak 94. The upper plate 31 encounters both the jet 60 and the auxiliary plate, thus its velocity being reduced to $V_B$ of about 0.4 Km/s, designated by point 95. The speed of the plates 36 and 40 soon near so theses plates move substantially together at reduced speeds.

Figure 5A:
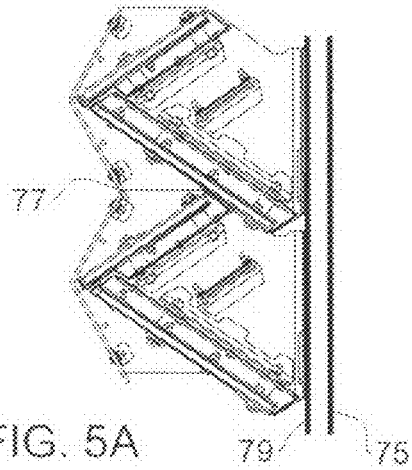
FIG. 5A (Prior Art)
FIGS. 5A and 5B schematically illustrate a side wall of a target body fitted with a prior art armor assembly, and an armor assembly according to the present invention, respectively, both of which fitted also with a passive armor plate.
Figure 5B:
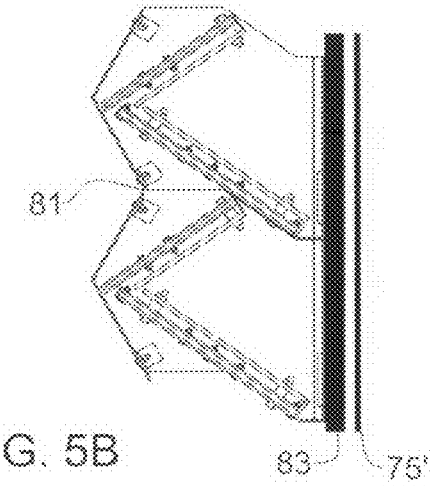

An armor module 10 according to the present invention allows reducing the overall weight of the reactive armor while achieving a similar, if not better result. FIG. 5A schematically illustrates a side wall 75 of a target body, e.g. an armored vehicle, fitted with a prior art armor assembly 77 (e.g. of the type illustrated in FIG. 1A), with a passive armor plate 79, made of steel and extending between an outer surface of the target wall 75 and a rear of the armor modules 77. In FIG. 5B there is schematically increasing an armor assembly 81 according to the present invention fitted onto a side wall 75' of a target body.

It is noted that owing to the reduction in overall weight of the armor assembly 81, the steel passive armor plate 83 can be substantially thicker and thus provide improved protection and withstand additional threats, for example, an IED.

Figure 6:
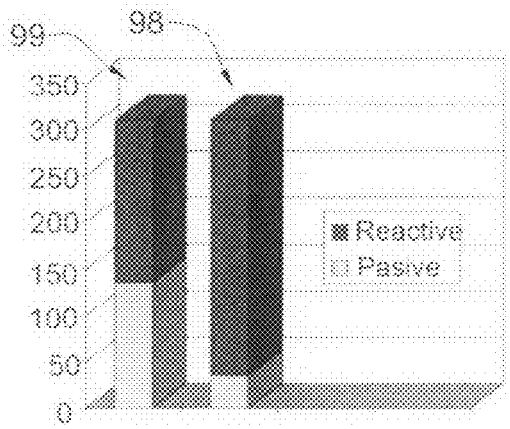
FIG. 6 is a diagram showing a comparison of weight distribution between an armor known in the art and an armor according to the present invention.

With further reference to FIG. 6, a comparison of the weight distribution of the overall weight of an armor between a corresponding prior art armor module (designated 98 in FIG. 6) and a module according to the present invention (designated 99 in FIG. 6) is shown. It is clear that under the same overall weight, 310 Kg, the module 10 according to the present invention may be equipped with about 5 times more weight, i.e. 175 Kg as opposed to 35 Kg.

Those skilled in the art to which this invention pertains will readily appreciate that numerous changes, variations, and modifications can be made without departing from the scope of the invention, mutatis mutandis.

The invention claimed is:

1. A reactive armor module for protecting a target from an incoming projectile, comprising:

at least one armor cassette comprising a front base plate, a rear base plate, and at least one layer of energetic material sandwiched therebetween, said front base plate and said rear base plate configured, upon impact of said projectile with said energetic material, to be propelled in opposite directions;

at least one substantially solid, non-energetic auxiliary plate facing said at least one armor cassette and being positioned essentially along the expected trajectory of either said front or said rear base plate, and spaced apart from both said at least one armor cassette and from said target, said at least one non-energetic auxiliary plate configured such that when said front or rear base plate is propelled towards said at least one non- energetic auxiliary plate, the velocity of said base plate is reduced upon collision with said at least one non-energetic auxiliary plate; and a casing holding said at least one armor cassette and said at least one non-energetic auxiliary plate, said casing having at least an external wall, positioned externally of both said at least one armor cassette and said at least one non-energetic auxiliary plate, so that said incoming projectile impacts said external wall prior to either of said at least one armor cassette and said at least one non-energetic auxiliary plate, wherein said at least one non-energetic auxiliary plate is configured for displacement along said trajectory with the propelled base plate with which collision took place, at a reduced velocity.

2. The reactive armor module according to claim 1, wherein said at least one substantially solid, non-energetic auxiliary plate comprises a plurality of non-energetic auxiliary plates spaced from one another and configured for operating with one of said at least one armor cassette.

3. The reactive armor module according to claim 1, comprising two non-energetic auxiliary plates, one spaced from said front base plate, and another spaced from said rear base plate, such that said at least one armor cassette is sandwiched between said non-energetic auxiliary plates.

4. The reactive armor module according to claim 1, wherein the ratio between a length L of a base plate of said at least one armor cassette and a distance d between said at least one non-energetic auxiliary plate and the respective base plate is about 5-20%.

5. The reactive armor module according to claim 1, wherein a length L of the base plate is in the range of between about 250-350 mm, and said at least one non-energetic auxiliary plate is spaced at a distance of 15±10 mm therefrom.

6. The reactive armor module according to claim 1, wherein the said at least one non-energetic auxiliary plate is positioned substantially parallel to one of said base plate, such that, when propelled by said energetic material, said base plate is designed to collide with said at least one non-energetic auxiliary plate and have a maximal contact area.

7. The reactive armor module according to claim 1, wherein said at least one non-energetic auxiliary plate is made of plastically deformable material.

8. The reactive armor module according to claim 1, wherein said a casing includes at least two side walls, and said at least one cassette and said at least one non-energetic auxiliary plate extend between said side walls, wherein side edges of said at least one armor cassette and said at least one non-energetic auxiliary plate are attached to side walls of said casing, thereby increasing structural strength of said at least one armor module.

9. The reactive armor module according to claim 8, wherein said side edges of said at least one armor cassette and said at least one non-energetic auxiliary plate are preformed with lateral projections inserted and fixedly attached into apertures pre-formed in said side walls of said casing.

10. The reactive armor module according to claim 9, wherein said lateral projections of said at least one armor cassette and said at least one non-energetic auxiliary plate are soldered within said apertures pre-formed in said side walls of said casing.

11. A target body fitted with an armor module according to claim 1.

12. The reactive armor module according to claim 1, wherein said at least one non-energetic auxiliary plate is substantially parallel to said at least one armor cassette.

13. The reactive armor module according to claim 1, wherein said at least one non-energetic auxiliary plate stands alone from said at least one armor cassette.

14. An armor module adapted to protect a target body from an incoming projectile, said armor module comprising:

at least one armor cassette comprising a front base plate, a rear base plate, and at least one layer of energetic material sandwiched therebetween;

at least one substantially solid, non-energetic auxiliary plate facing said at least one armor cassette and being positioned essentially along the expected trajectory of either said front or said rear base plate, and spaced apart from both said at least one armor cassette and from said target, said at least one non-energetic auxiliary plate configured such that when said front or rear base plate is propelled towards said at least one non-energetic auxiliary plate, the velocity of said base plate is reduced due to collision with said at least one non-energetic auxiliary plate ; and a casing holding said at least one armor cassette and said at least one non-energetic auxiliary plate, said casing having at least an external wall, positioned externally of both said at least one armor cassette and said at least one non-energetic auxiliary plate, so that said incoming projectile impacts said external wall prior to either of said at least one armor cassette and said at least one non-energetic auxiliary plate, said casing comprising two side walls confining said at least one armor cassette between said two side walls, wherein said at least one non-energetic auxiliary plate is configured for displacement along said trajectory with the propelled base plate with which collision took place, at a reduced velocity.

15. The reactive armor module according to claim 14, wherein said at least one non-energetic auxiliary plate is substantially parallel to said at least one armor cassette.

16. A method for protecting a target body against projectiles and shaped-charged warheads, the method comprising:

fitting the target body on an outside thereof with at least one armor module comprising:

at least one armor cassette comprising a front base plate, a rear base plate, and at least one layer of energetic material sandwiched therebetween;

at least one substantially solid, non-energetic auxiliary plate facing said at least one armor cassette and being positioned essentially along the expected trajectory of either said front or said rear base plate, and spaced apart from both said at least armor cassette and from said target, said at least one non-energetic auxiliary plate configured such that when said front or rear base plate is propelled towards said at least one non-energetic auxiliary plate, the velocity of said base plate is reduced due to collision with said at least one non-energetic auxiliary plate ; and a casing holding said at least one armor cassette and said at least one non-energetic auxiliary plate, said casing having at least an external wall, positioned externally of both said at least one armor cassette and said at least one non-energetic auxiliary plate, so that said incoming projectile impacts said external wall prior to either of said at least one armor cassette and said at least one non-energetic auxiliary plate, said casing comprising two side walls confining said at least one armor cassette between said two side walls, wherein said at least one non-energetic auxiliary plate is configured for displacement along said trajectory with the propelled base plate with which collision took place, at a reduced velocity.

17. The method according to claim 16, wherein said at least one armor module is directly mounted onto an outer wall of the target body at a slanted orientation with respect to the expected direction of said incoming projectile.

18. The method according to claim 16, wherein a plurality of armor modules are mounted onto the target body wherein the walls of said at least one armor module are designed so as to allow mounting of a plurality of similar armor modules onto said target body in a tessellated form, such that an edge of one module adjoins a bottom edge of an adjacent module.

19. The method according to claim 16, said at least one non-energetic auxiliary plate is substantially parallel to the armor cassette.

* * * * *